US008794938B2

(12) United States Patent
Frey

(10) Patent No.: US 8,794,938 B2
(45) Date of Patent: Aug. 5, 2014

(54) CYLINDER PISTON ARRANGEMENT FOR A FLUID PUMP OR A FLUID MOTOR

(76) Inventor: Bernhard Frey, Schaffhausen (CH)

( * ) Notice: Subject to any disclaimer, the term of this patent is extended or adjusted under 35 U.S.C. 154(b) by 691 days.

(21) Appl. No.: 12/373,417

(22) PCT Filed: Jul. 11, 2007

(86) PCT No.: PCT/IB2007/001953

§ 371 (c)(1),
(2), (4) Date: Oct. 23, 2009

(87) PCT Pub. No.: WO2008/007209

PCT Pub. Date: Jan. 17, 2008

(65) Prior Publication Data

US 2010/0119394 A1 May 13, 2010

(30) Foreign Application Priority Data

Jul. 11, 2006 (CH) ..... 1119/06

(51) Int. Cl.
*F04B 53/10* (2006.01)
*F04B 39/00* (2006.01)

(52) U.S. Cl.
USPC ..... 417/567; 417/900; 92/90

(58) Field of Classification Search
USPC ..... 417/567, 900, 472; 92/248, 89–93; 137/543.15
See application file for complete search history.

(56) References Cited

U.S. PATENT DOCUMENTS 1,942,417 A 1/1934 Ferlin et al.
2,606,032 A * 8/1952 Warren ..... 137/512
3,227,093 A * 1/1966 Taplin ..... 92/80
3,250,225 A * 5/1966 Taplin ..... 417/413.1
3,309,013 A * 3/1967 Helmut ..... 417/567
3,311,028 A * 3/1967 Taplin ..... 92/99
3,375,759 A * 4/1968 Smith ..... 92/98 D (Continued)

FOREIGN PATENT DOCUMENTS

DE 2914694 1/1980
DE 19648408 5/1998

(Continued)

OTHER PUBLICATIONS

NPL English machine translation of foreign French patent, Jean-Jacques Carre et al, FR 2375466A1, "Hydraulic Pump", published Jul. 21, 1978; downloaded from http://worldwide.escapenet.com.*

(Continued)

*Primary Examiner* — Devon Kramer
*Assistant Examiner* — Thomas Fink
(74) *Attorney, Agent, or Firm* — Pearl Cohen Zedek Latzer Baratz LLP

(57) ABSTRACT

The invention relates to a cylinder piston arrangement for an especially volumetric fluid pump or a fluid motor, preferably comprising at least one axial expansion tubular membrane piston defining at least one inner pulsating working chamber. A particular field of application for such pumps or motors is the operation thereof with fluids loaded with extraneous materials, especially abrasive granulated materials. Especially high-speed machines with high working pressures of between a few hundred to a thousand bar are required, the energetic and also volumetric degree of efficiency thus becoming highly important factors. The aim of the invention is therefore to create pumps or fluid motors which are characterized by high degrees of efficiency and long service lives. To this end, at least one clearance driving body (TK1) is actively connected to the pulsating working chamber (AR).

7 Claims, 6 Drawing Sheets

(56) References Cited

U.S. PATENT DOCUMENTS

| | | | | |
|---|---|---|---|---|
| 4,172,465 | A * | 10/1979 | Dashner | 137/533.27 |
| 4,248,403 | A * | 2/1981 | Scull | 251/85 |
| 4,718,893 | A * | 1/1988 | Dorman et al. | 604/67 |
| 4,741,252 | A * | 5/1988 | Harter et al. | 92/103 SD |
| 4,749,342 | A * | 6/1988 | Fritsch | 417/388 |
| 4,773,305 | A * | 9/1988 | Nissels | 92/98 D |
| 5,005,465 | A * | 4/1991 | Boehm et al. | 91/369.1 |
| 5,027,784 | A * | 7/1991 | Osawa et al. | 123/572 |
| 5,088,898 | A * | 2/1992 | Fukumoto et al. | 417/347 |
| 5,251,664 | A * | 10/1993 | Arvidsson et al. | 137/514 |
| 6,048,183 | A * | 4/2000 | Meza | 417/569 |
| 7,278,836 | B2 * | 10/2007 | Hammonds | 417/515 |
| 7,293,967 | B2 * | 11/2007 | Fukano et al. | 417/413.1 |

FOREIGN PATENT DOCUMENTS

| | | | |
|---|---|---|---|
| DE | 19648408 | A1 * | 5/1998 |
| EP | 0222131 | | 5/1987 |
| FR | 2375466 | | 7/1978 |
| FR | 2375466 | A1 * | 7/1978 |

OTHER PUBLICATIONS

International Search Report of Application No. PCT/IB2007/001953, dated Dec. 28, 2007.

* cited by examiner

CYLINDER PISTON ARRANGEMENT FOR A FLUID PUMP OR A FLUID MOTOR

CROSS-REFERENCE TO RELATED APPLICATIONS

This application is a national phase application of PCT/IB2007/001953 filed on Jul. 11, 2007 which in turn claims priority from Swiss application 01119/06, filed on Jul. 11, 2006, each of which are incorporated by reference herein in their entirety.

FIELD OF THE INVENTION

The invention relates to a cylinder piston arrangement according to the preamble of claim 1. Cylinder piston arrangements of this kind are present on the market, especially as high pressure water pumps.

BACKGROUND

An essential application for pumps of this kind is the pressure conveyance of water loaded with foreign particles, especially abrasive granulates. Particularly, high speed turbines with high working pressures in the range of a few hundred up to one thousand bar are required. Therefore, the energetic as well as the volumetric efficiency factors are of great importance.

SUMMARY

The objective of the invention is therefore to provide pumps, respectively fluid engines, with high efficiency factors of the above-mentioned kind as well as with high durability. The solution of this objective is defined by the features of the claim 1.

Further embodiments and variants, that are not in any case realizable, result from the features and the combinations of features, respectively, by the combination of the subclaims, as the case may be, by including optional features or combinations of features.

Axially expanding tube diaphragm pistons with internally working chambers offer the basis for a robust construction with high wear resistance, also in operation with abrasive fluids. However, generally in this case, relatively large clearance volumes need to be kept due to constructive reasons, which affects the volumetric efficiency factor disadvantageously. Exactly this problem is solved by the invention, namely with the help of clearance volume displacers. All in all, the invention makes a widely optimized type of construction possible.

BRIEF DESCRIPTION OF THE DRAWINGS

The invention will further be described with reference to the exemplary embodiment schematically shown in the drawings, which show.

DETAILED DESCRIPTION

In the embodiment 10 according to FIG. 1, a working piston provided with an axially expanding tube diaphragm (shown in upper dead center position and denominated in the following shortly as ASK) coupled at its lower end with an oscillatory operating driving device AVO, which is shown here only by a downwards directed arrow. The upper end of the axially expanding tube diaphragm piston ASK is arranged fixedly to the frame and surrounds an inlet valve EV, which is accomplished as a non return valve fed over inlet ducts EK. The downwardly extending, hollow cylindrical section Z of the axially expanding tube diaphragm ASK piston is supported by an axially slidable lubrication in a housing borehole GB which is not shown here. In the interior of the axially expanding tube diaphragm piston ASK, an oscillating working chamber AR, from which a coaxial hoist duct FK leads to an outlet valve AV—also constructed as a non-return valve—and to an outlet duct AK.

On the side of the working chamber AR, a basically cylindrical clearance volume displacer TK1 is connected with the axially expanding tube diaphragm piston ASK, which is shown here in the upper dead center position and obviously results in a substantial reduction of the operative clearance volume.

Figure 5:
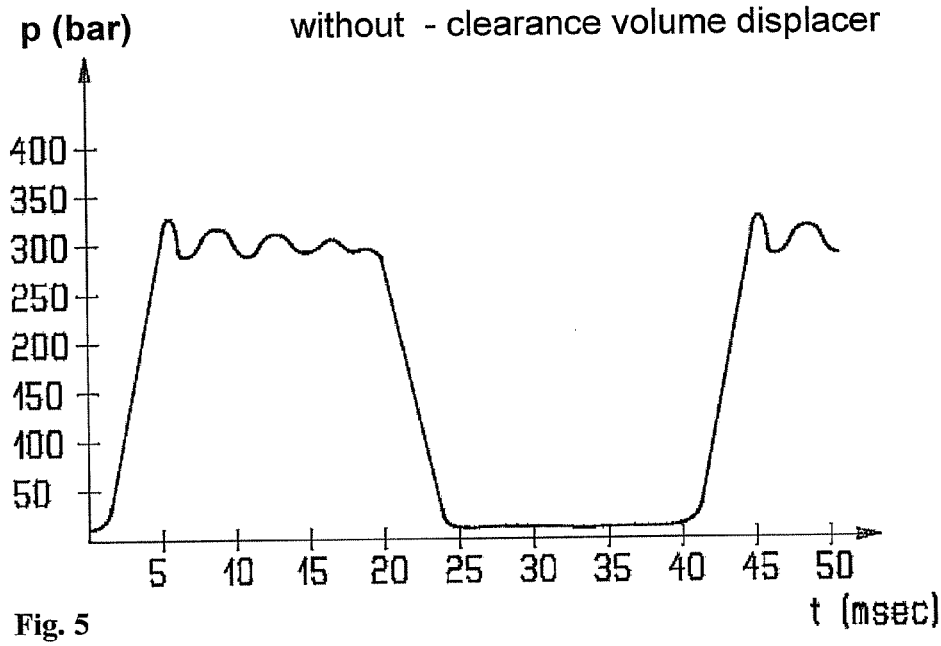
FIG. 5 a time diagram of the feed pressure p (bar) for a working piston of a volumetric pump over time t (msec), for a construction without clearance volume displacer.
Figure 6:
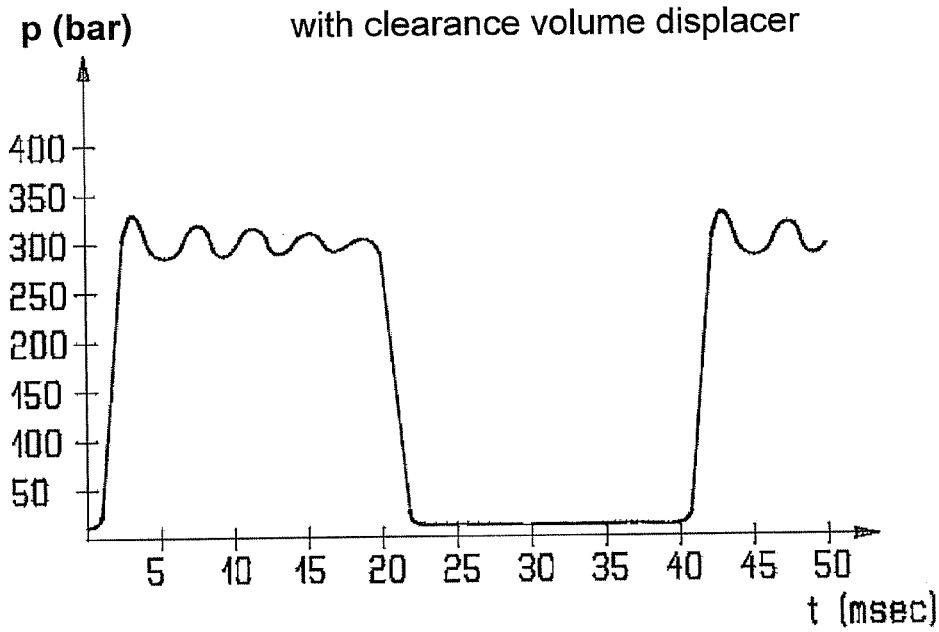
FIG. 6 a diagram according to FIG. 5, for a construction with clearance volume displacer. This latter depiction relates basically not only to moveable clearance volume displacers coupled with the working piston (see FIG. 1), but also for frame-fixed static clearance volume displacers, which intrude into the working chamber by its movement (see FIGS. 2 to 4). This comes into consideration especially in case of application of axially expanding tube diaphragm pistons, and FIG. 7 a valve construction.

For describing the operating mode of this construction, it is to be referred to the already provided depiction in the FIGS. 5 and 6.

There the time diagram shows in FIG. 5 a slowed-down increase of the feed pressure p for a working piston of a volumetric pump for a construction without clearance volume displacer. Accordingly slowed-down is the pressure loss at the end of the pumping cycle. Both imply a considerable reduction of the pumping volume related to piston travel, i.e. of the volumetric efficiency factor. The reason for that is the compressibility of the working fluid contained in the clearance volume.

Figure 1:
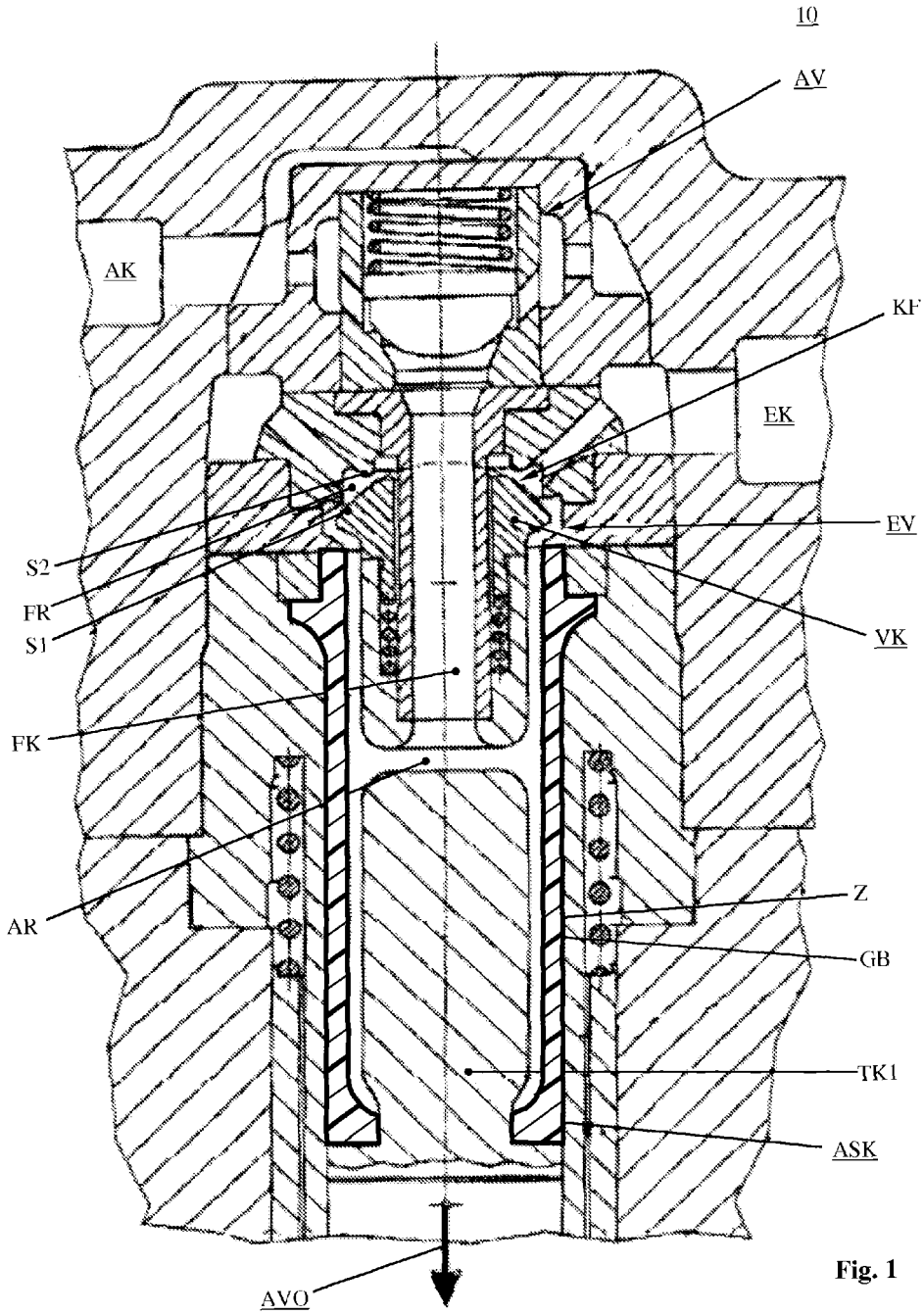
FIG. 1 a partial axial sectional view of a high pressure pump with a working piston constructed as an axially expanding tube diaphragm piston, with which an interfering into the working chamber and with the oscillating driving movement participating clearance volume displacer is coupled.

In contrast, the clearance volume displacer TK1, intruding according to FIG. 1 into the working chamber AR, causes the steepening of the pressure increase as well as the pressure loss visualized in FIG. 6, thus resulting in a substantial improvement of the volumetric efficiency factor.

Figure 2:
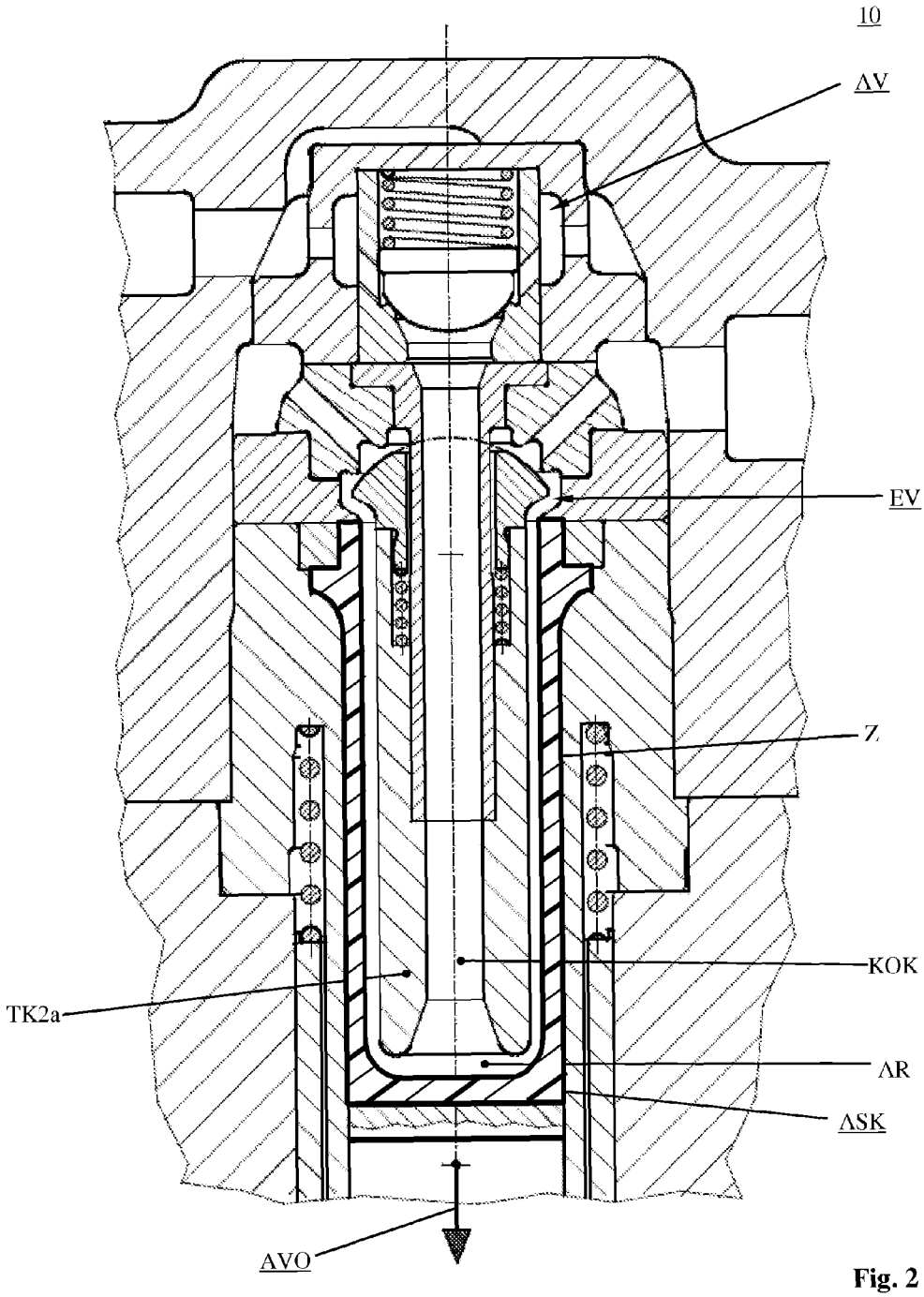
FIG. 2 a partial axial sectional view similar to FIG. 1, also with a working piston constructed as an axially expanding tube diaphragm piston, with a clearance volume displacer, which is fixed to the frame of the pump and which—due to the oscillating working movement of the working piston relative to it—intrudes into the internal working chamber of the axially expanding tube diaphragm piston.

In the embodiment 10 according to FIG. 2, a frame-fixed clearance volume displacer TK2*a* is provided, which however intrudes into the working chamber AR and causes a similar improvement of the volumetric efficiency factor due to the arrangement of the working chamber AR inside the axially expanding tube diaphragm piston ASK and thus due to the relative movement given by the pump drive between the axially expanding tube diaphragm piston ASK and the clearance volume displacer TK2*a*. Especially advantageous here is the reduction of moved mass due to the frame-fixed clearance volume displacer TK2*a*.

Inlet valve EV and outlet valve AV are constructed analogously to the embodiment 10 according to FIG. 1, but the connection between working chamber AR and outlet valve AV is given by a longer coaxial duct KOK inside the clearance volume displacer TK2*a* and inside the inlet valve EV.

Particularly advantageously appears in this embodiment 10, that for the displacer TK2*a* an internal flow-through and an external circulation flow of the working fluid with a flow redirection in an opening or end area of the clearance volume displacer TK2*a* is provided. By this, inter alia, an extra intensive purging of the working chamber AR and the valves regarding accumulation of residues and impurities, but also of compression attenuating air enclosures after longer dead times, is made possible.

Figure 3:
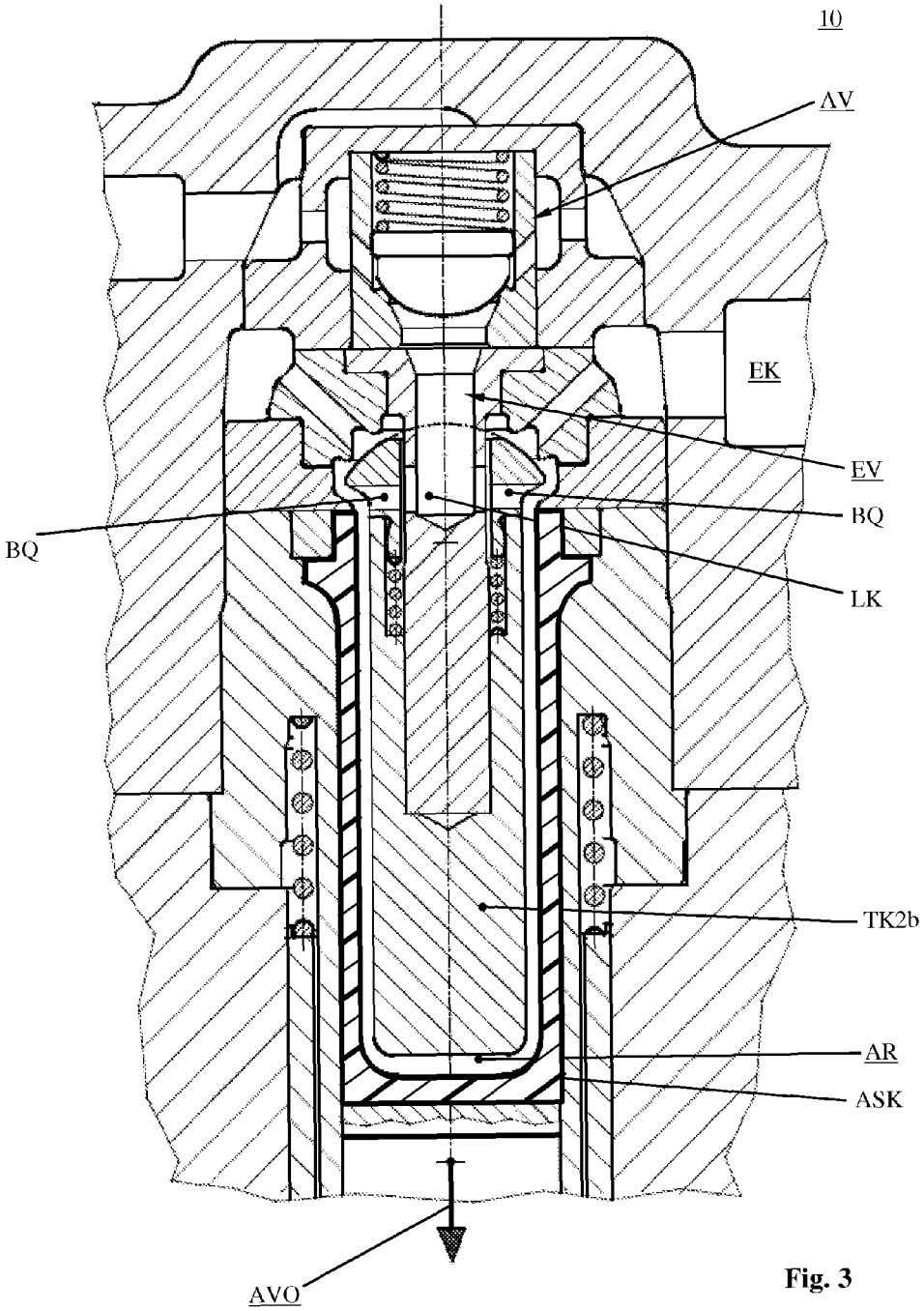
FIG. 3 a partial axial sectional view similar to FIG. 2, also with a working piston constructed as an axially expanding tube diaphragm piston with internal working chamber, with a frame-fixed clearance volume displacer, but with different flow path of the working fluid.

In the embodiment 10 according to FIG. 3, a frame-fixed clearance volume displacer TK2*b* is provided again, with the corresponding dynamic advantages. At the same time, however a maximization of the clearance volume displacement is achieved by the discontinuance of a relatively long, with the working chamber AR in connection standing, coaxial duct. The discharge of the fluid occurs from the working chamber AR over cross-holes BQ directly below the inlet valve EV as well as a short and thus practically non-disturbing longitudinal duct LK.

Figure 4:
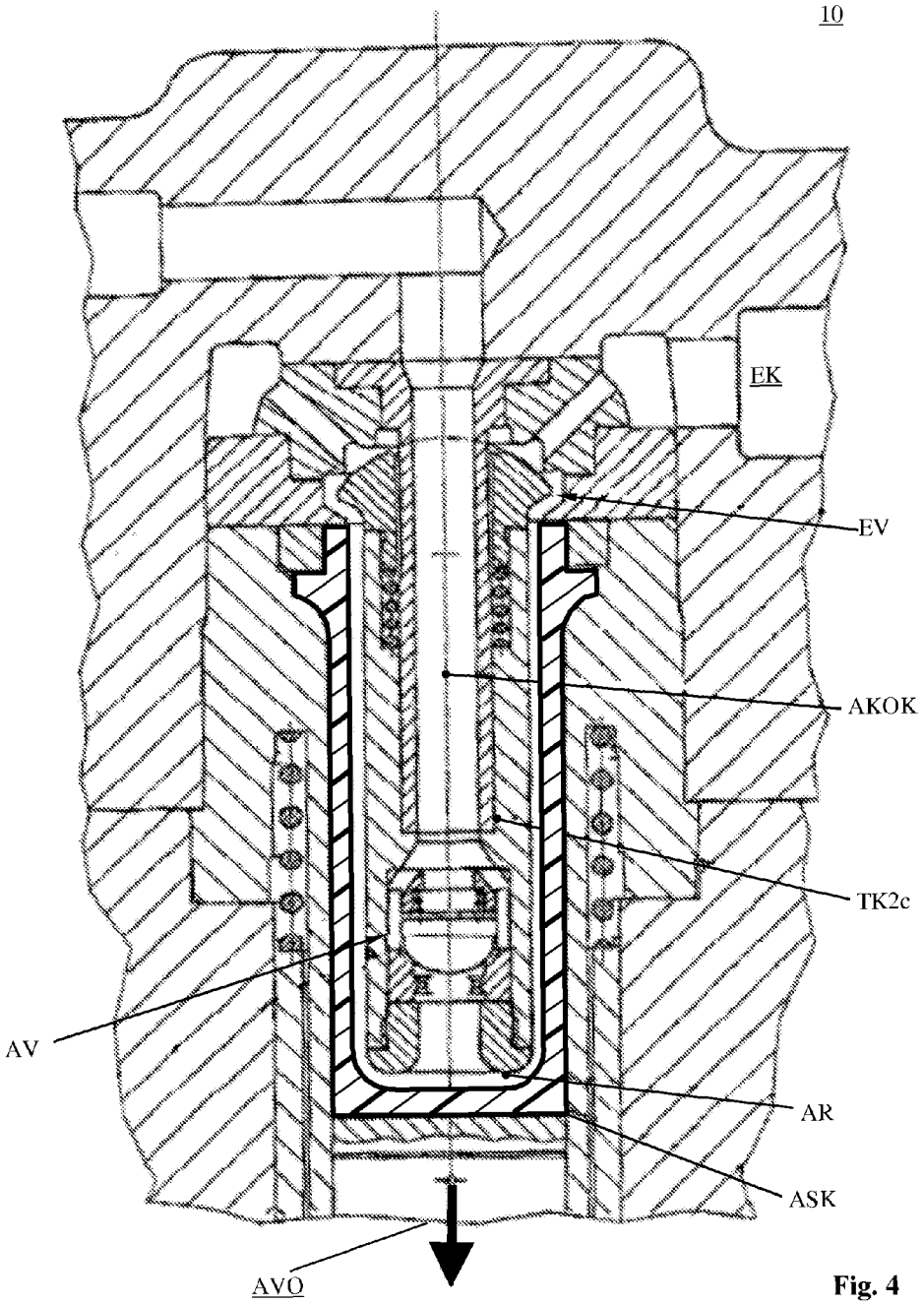
FIG. 4 a partial axial sectional view similar to FIG. 3, also with a working piston constructed as an axially expanding tube diaphragm piston with internal working chamber, with a frame-fixed clearance volume displacer, but with different flow path of the working fluid and with different valve arrangement, altogether resulting in a further reduced clearance volume.

In the embodiment 10 according to FIG. 4, a frame-fixed clearance volume displacer TK2*c* is also provided with the corresponding dynamic advantages. Additionally, an optimal clearance volume displacement is provided by a compression-inactive arrangement of the outlet valve AV at the working-chamber end of an outlet coaxial duct AKOK.

Figure 7:
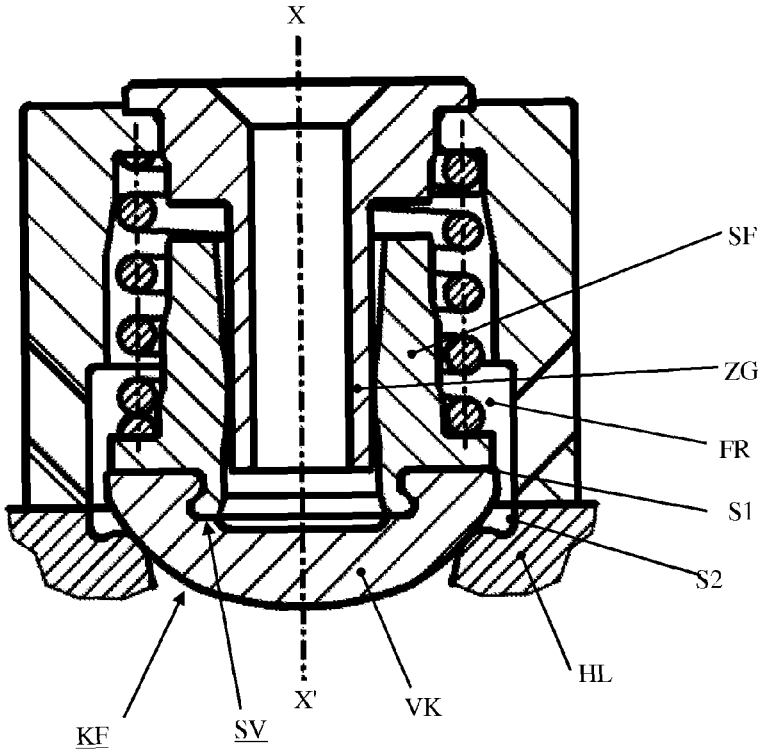

Additionally, a valve construction according to FIG. 7 is to be referred to, which comes into consideration especially for outlet valves AV. Here, an outlet valve body VK, formed as partial sphere jacket, is swivel-mounted around the sphere center relative to a correspondingly form-fitted valve seat. However, at the same time a longitudinal guide by means of a swivel guide SF and a centering element ZG is required. The latter is connected with the valve body VK by a tight-elastic spring lock SV, so that for the swivel guide SF a relatively light and oscillation damping material comes into consideration. Regarding the mentioned swivability, the internal borehole of the swivel guide SF is formed slightly toroid-shaped with a suitable clearance-slip-joint for the centering element ZG. Such a construction has proved itself by high stability under load and wear resistance.

The invention claimed is:

1. A cylinder piston arrangement for a volumetrically operating fluid pump or a fluid engine, comprising:

at least one axially expanding tube diaphragm piston confining at least one internal, axially pulsating working chamber, wherein said pulsating working chamber directs fluid inward through an inlet and outward through an outlet;

a housing borehole acting as a cylinder, said housing borehole configured to inhibit radial expansion of the tube diaphragm piston when directing fluid outward through the outlet;

at least one axially extending clearance volume displacer provided within the pulsating working chamber and intruding into the pulsating working chamber, said clearance volume displacer configured to substantially reduce clearance volume within the pulsating working chamber;

wherein between said housing borehole and said at least one axially extending clearance volume displacer a downwardly extending hollow cylinder section of the axially expanding tube diaphragm piston is axially slidably supported, corresponding to the expansion of the axially expanding tube diaphragm piston, in said housing borehole.

2. The cylinder piston arrangement according to claim 1, wherein the working chamber further comprises an internal flow-through and an external circulation flow by a working fluid with a flow redirection in an opening or end area of the clearance volume displacer.

3. The cylinder piston arrangement according to claim 2, further comprising: an inlet valve and a corresponding outlet valve formed as a multiple-bedded stroke valve arranged in the fluid flow;

the working chamber formed in an area between the inlet valve and outlet valve.

4. The cylinder piston arrangement according to claim 3, wherein at least a part of the hubs of the multiple-bedded stroke valve comprise sealing lines or sealing surfaces running along a sphere surface.

5. The cylinder piston arrangement according to claim 3, wherein the multiple-bedded stroke valve comprises at least one valve body having at least one sphere-shaped sealing surface, said at least one valve body being changeable between a closure and a passage and movably supported relative to at least one sealing line or sealing surface.

6. The cylinder piston arrangement according to claim 5, wherein the valve body is movably supported about a swivel axis running through the center of the sphere-shaped surface or a corresponding swivel point.

7. The cylinder piston arrangement according to claim 5, wherein the valve body comprises a swiveling support having a retaining bracket, which cooperates with a convex or concave curved swivel guide, and wherein an elastically deformable spring lock is provided between the valve body and the swivel guide.

* * * * *